United States Patent [19]

Dellepiane et al.

[11] 4,303,182

[45] Dec. 1, 1981

[54] DEVICE FOR ELASTICALLY CLAMPING A SLIDING DISCHARGE GATE BY A TORSION BAR

[75] Inventors: Enrico Dellepiane; Roberto Ricci; Giovanni Timossi, all of Genoa, Italy

[73] Assignee: Sanac Societa per Azioni Refrattari Argille e Caolini, Italy

[21] Appl. No.: 106,241

[22] Filed: Dec. 21, 1979

[30] Foreign Application Priority Data

Dec. 22, 1978 [IT] Italy ..... 12913 A/78

[51] Int. Cl.[3] ..... B22D 41/08

[52] U.S. Cl. ..... 222/600; 222/512

[58] Field of Search ..... 251/159, 170, 195; 222/598, 600, 512, 560, 561

[56] References Cited

U.S. PATENT DOCUMENTS 3,047,024 7/1962 Schuller ..... 251/159 X

FOREIGN PATENT DOCUMENTS 505520 11/1974 U.S.S.R. ..... 222/600

550238 9/1975 U.S.S.R. ..... 222/600

*Primary Examiner*—David A. Scherbel

*Attorney, Agent, or Firm*—Robert E. Burns; Emmanuel J. Lobato; Bruce L. Adams

[57] ABSTRACT

A discharge gate clamping device for clamping a lower plate of a discharge gate. A pair of torsion bars are mounted on the side of the lower plate each having a respective first end connected to a crank arm, and each torsion bar has a second end carrying a cam. When the crank arm is rotated the torsion bars rotate for rotating the cams which press against a surface for lifting the lower plate upward. Because each cam is mounted on an independent torsion bar, a uniform pressure is applied to the lower plate of the discharge gate.

7 Claims, 13 Drawing Figures

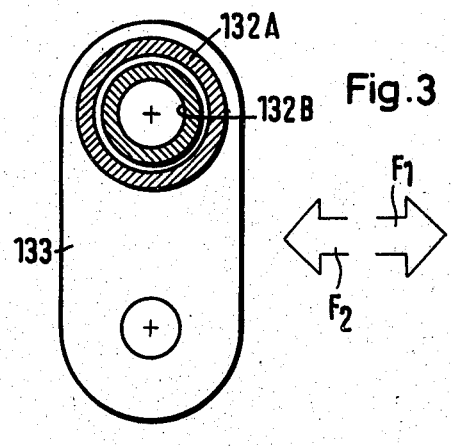
Fig.3
Fig.4
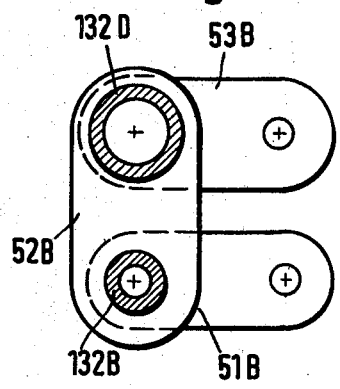
Fig.5
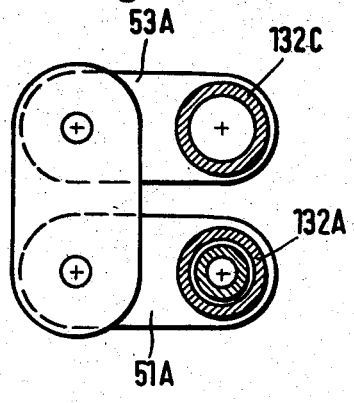
Fig.6
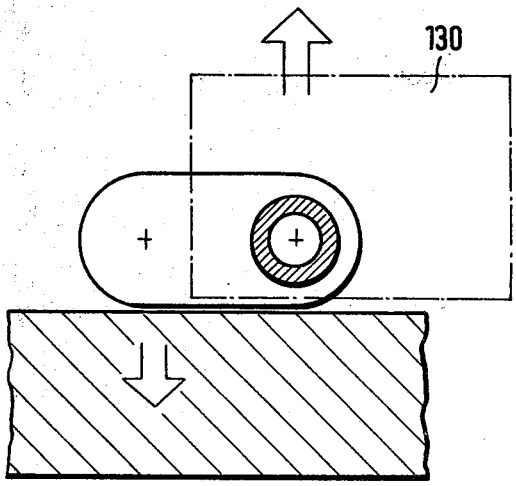

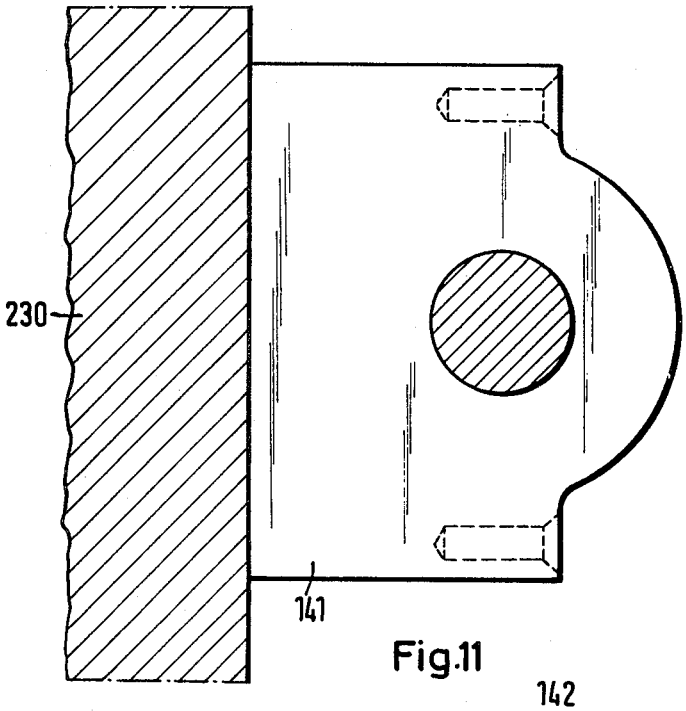
Fig.10
Fig.11
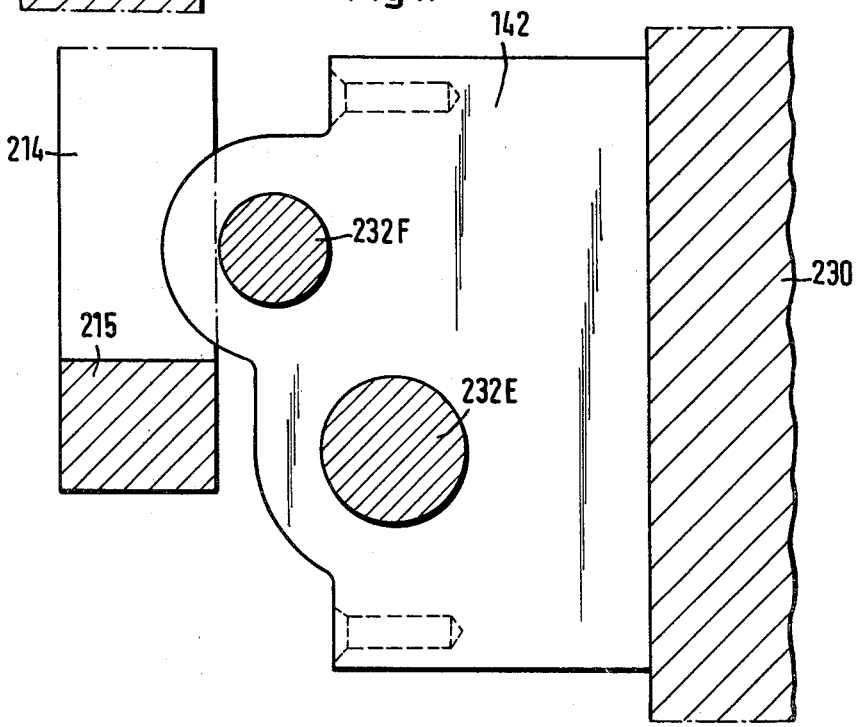

DEVICE FOR ELASTICALLY CLAMPING A SLIDING DISCHARGE GATE BY A TORSION BAR

BACKGROUND OF THE INVENTION

It is known that sliding discharge gates for ladles and in general for large-sized containers of liquid metal, are used with ever increasing frequency in foundries.

In fact, compared to rod gates, which are still used in many old-fashioned plants, sliding discharge gates have the advantages of allowing the flow of steel which issues from the base of the ladle to be controlled more precisely, on the one hand, and on the other hand, permit the refractories of the discharge gate to be replaced while working from the outside of the ladle and thus without waiting for the ladle to be cooled down. As a result the sliding discharge gate have better operative characteristics and allow maintenance to be carried out more rapidly.

It is also known that sliding discharge gates in general have a first, fixed metallic support plate arranged below the base of the ladle, on whose lower face is fixed in any suitable manner a first stationary refractory brick whose centre is apertured and through which passes the jet of liquid steel when the discharge gate is in the open position. Said first fixed plate supports, in an adjustable manner by way of a suitable series of bolts, a second metallic support plate which is also fixed in the operative position of the discharge gate.

The second fixed plate also has a large aperture in the centre for the passage of the liquid metal; the function of said second fixed plate is to define, with the first metallic fixed plate, a horizontal space in which a third slidable metallic support plate slides.

On said third slidable plate is fixed a second apertured refractory brick which is slidable together with said slidable plate; when the apertures of the first and second bricks are aligned, the discharge gate is in the open position; when on the other hand the apertures of the two bricks are not aligned and not even partially in register, the sliding discharge gate is closed. It is apparent that in such a closed position, the seal of the discharge gate is entirely due to the seal effected between the opposed faces and the contact between the two refractory bricks.

Having regard to the pressure applied by the metallic liquid above, it is not only necessary that the two opposed surfaces of the two refractory bricks be coplanar and in contact, but these surfaces must be pressed one against the other by the most uniform contact pressure possible over the whole of said contact surface. It results that at the moment of assembling the sliding discharge gate, the bolts by means of which one determines the distance between the first and second plates and hence the pressure exercised by the second plate on the third, moveable plate which is in turn thrust against the lower face of the first fixed plate, or upper plate, must be tightened with great care by means of torque wrenches; this requires a relatively long time; the time necessary for regulating the tightening force of the bolts has an important effect on the cost of using the sliding discharge gate, given that said adjustment need not only be carried out when assembling the slide. The refractory bricks referred to above, supported respectively by the first, upper fixed plate and by the third, intermediate, slidable plate wear out after a certain period of operation and thus must be replaced; for each replacement; it is necessary to open the sliding discharge gate and repeat the operation to tightening the bolts which serve to press the slidable refractory brick against the fixed refractory brick.

OBJECTS OF THE INVENTION

The object of the present invention is just that of providing means of tightening the second, lower, fixed plate against the third, intermediate, slidable plate which is above it in such a way that the latter plate bears with uniform pressure against the first, upper fixed plate, using a single adjustment element in such a way as to shorten to the maximum extent the operations of assembly and adjusting the sliding discharge gate.

BRIEF DESCRIPTION OF THE DRAWINGS

FIG. 3, FIG. 4, FIG. 5 and FIG. 6 are sections along the section planes III—III up to VI—VI of FIG. 2 above;

FIG. 8 is a bottom view of the device according to FIG. 6 above;

FIGS. 9 to 13 are sections along the planes IX—IX to XIII—XIII of FIG. 7 above.

DESCRIPTION OF THE PREFERRED EMBODIMENT

Figure 1:
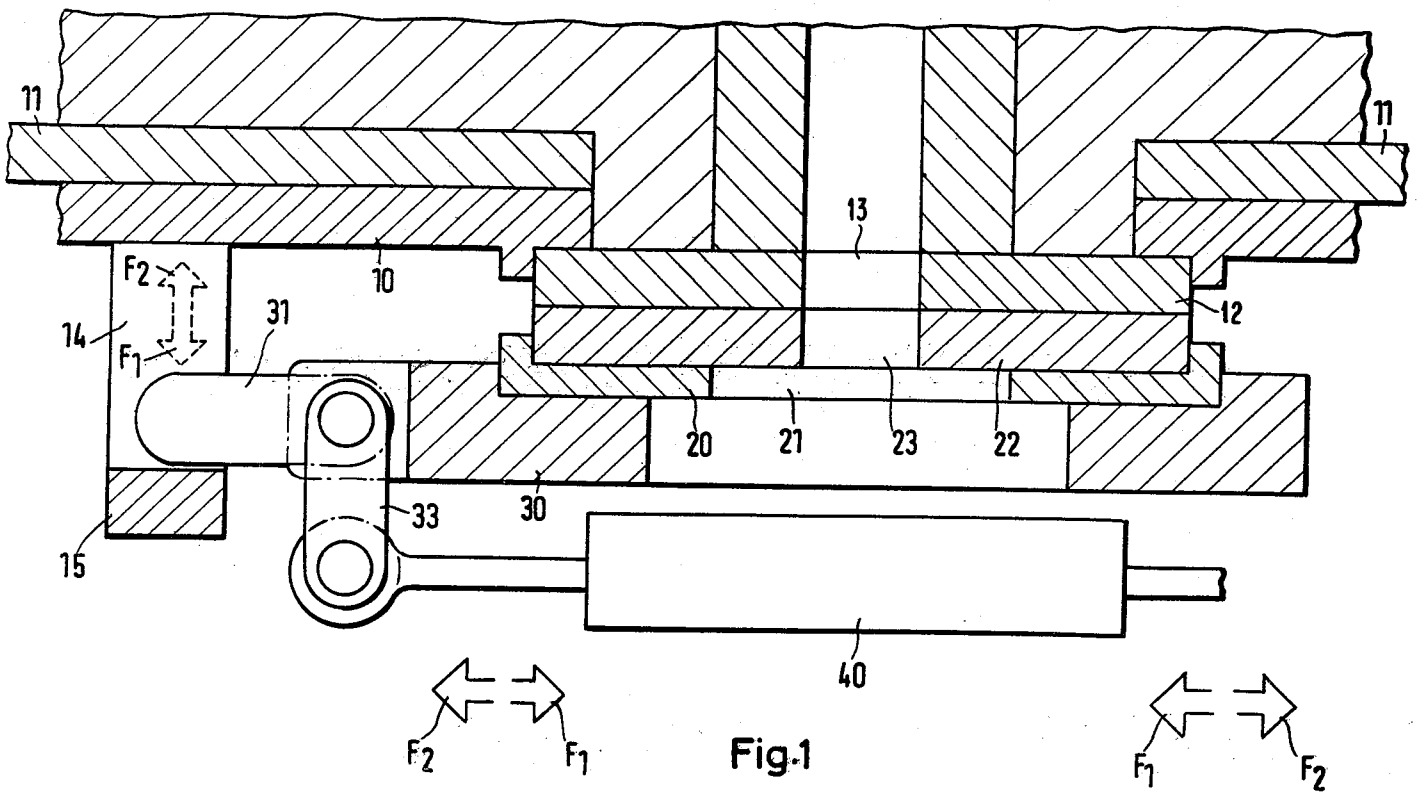
FIG. 1 shows a sliding discharge gate according to the invention, represented in a schematic manner, in transverse, vertical section.

With particular reference to FIG. 1, the sliding discharge gate comprises a first, stationary, upper plate 10, fixed directly to the base 11 of a ladle. The upper fixed plate 10 is provided with a central aperture and supports in a known manner a first refractory brick 12 provided with a central aperture 13 for the passage of liquid metal. From the lower face of the first, upper fixed plate 10 project downwards four mounts 14, only one of which is shown in FIG. 1 which shows the sliding discharge gate in section perpendicular to the direction of displacement of the intermediate, moveable plate 20. The intermediate, slidable plate 20 is also provided with a large central aperture 21 and supports above it a second refractory brick 22 provided with a central aperture 23.

In the position illustrated in FIG. 1, the apertures 13 and 23 of the two refractory bricks 12 and 22 are aligned and the sliding discharge gate is in its open position; when the intermediate, sliding plate 20 moves perpendicular to the plane of FIG. 1, the two apertures 13 and 23 are no longer aligned and the sliding discharge gate is in its closed position.

The slidable, intermediate plate 20 is moveable by means known per se, not illustrated in the Figure, above a second, lower fixed plate 30 which is provided with suitable guides for sliding the intermediate slidable plate 20.

The mounts 14 which project downwards from the upper, fixed plate 10 are connected down below, in pairs, by horizontal beams 15 parallel to the direction of sliding of the intermediate slidable plate 20.

On said horizontal beams 15 rest arms 31 which are pivoted to the lower, fixed plate 30 and are rotationally fixed to shafts 32 which in turn are provided, in accordance with the invention, with a suitable torsional flexibility and are rotationally fixed to crank arm 33 actuated by a single actuating element 40 which can be a double-acting ram, a screw tightener or an arrangement of hydraulic or elastic means, suitable for affecting, under control, horizontal forces directed outwards or inwards on the end of the crank arms 33 referred to above. The arms 31 act as cams, and the term "arms", "lever arms" and "cams" are used interchangably to describe elements 31.

When the actuating means 40 generate equal and opposite, inwardly directed forces indicated by the arrows F1 over the end of the crank arms 33, the latter, through the shafts 32, cause the arms 31 to rotate in the direction of the arrows F1.

As a result of said arms 31 forming a fulcrum above the upper face of the beams 15, they cause the lower fixed plate 30 to be raised. The latter in its turn thrusts the refractory brick 22 against the lower face of the refractory brick 12, and it is significant that as said clamping force is applied by a common actuating means 40, the upwards thrust applied to both sides, right and left of the slidable refractory brick 22, is equal. It is noted that the crank arm 33 and the arm 31 are arranged at the two ends of the shaft to allow the latter to twist.

If on the other hand one applies with the actuating means 40 a force in the direction of the arrows F2, the rotation of the crank arm 33 and of the arm 31 cause the lower fixed plate 31 to be lowered and thus the brick 22 to be detached from the brick 12.

According to the invention, and as will be shown with particular reference to the following Figures, there is not only the result that with a single actuating means 40 the upwards thrust of the brick 22 against the brick 12, to the right and to the left, is put in equilibrium; but there is also the result that said upwards pressure thrust is also in equilibrium in the direction of the length of the sliding discharge gate, the direction of the length which is perpendicular to the plane of the FIG. 1. It should be stated that FIG. 1 is a simplified representation of the embodiments shown in FIGS. 2 to 6, and 7 to 13, respectively; the same elements are however distinguished by reference numerals which are increased by 100 and 200, respectively.

With particular reference to FIGS. 1 to 6; the actuating means 40 apply an internally directed traction in the direction of the arrow F1 on the lower end of the left-hand crank arm 133.

At the upper end, the crank arm 133 is keyed to two hollow, concentric shafts 132A and 132B.

Said two shafts are suitably supported by the fixed, lower plate 130 through the supports 41 to 44. However, under the action of the force F1 applied by the means 40, the two shafts 132A and 132B rotate in an anti-clockwise direction (see FIG. 3). At the opposite end to that of the crank arm 133, each of the two shafts 132 is keyed to a second crank arm 51A and 51B, respectively. Said crank arms rotate in the same direction as the crank arm 133 but not necessarily to the same degree having regard to the torsional flexibility of the shafts 132 which are hollow precisely for this purpose. It should be noted that the rotation, in the same sense, of the two crank arms 51A and 51B is not in general equal, given that the two hollow shafts 132 are keyed to each other only at the position of the crank arm 133.

The rotation of the crank arms 51A and 51B, respectively, is transmitted by way of a small connecting rod 52A or 52B, respectively, to the crank arms 53A and 53B which are keyed onto the hollow shafts 132C and 132D, respectively. At their opposite ends, the shafts 132C and 132D are finally keyed to the arms 131A and 131B whose free ends abut against the beam 115.

The shafts 132 are supported by supports 42 and 43 or 44 and 45, respectively, fixed to the lower fixed plate 130. Said shafts extend symmetrically from one side or the other with respect to the extreme ends of the shafts 132A and 132B which are at about halfway relative to the length of the lower fixed plate 130.

Figure 2:
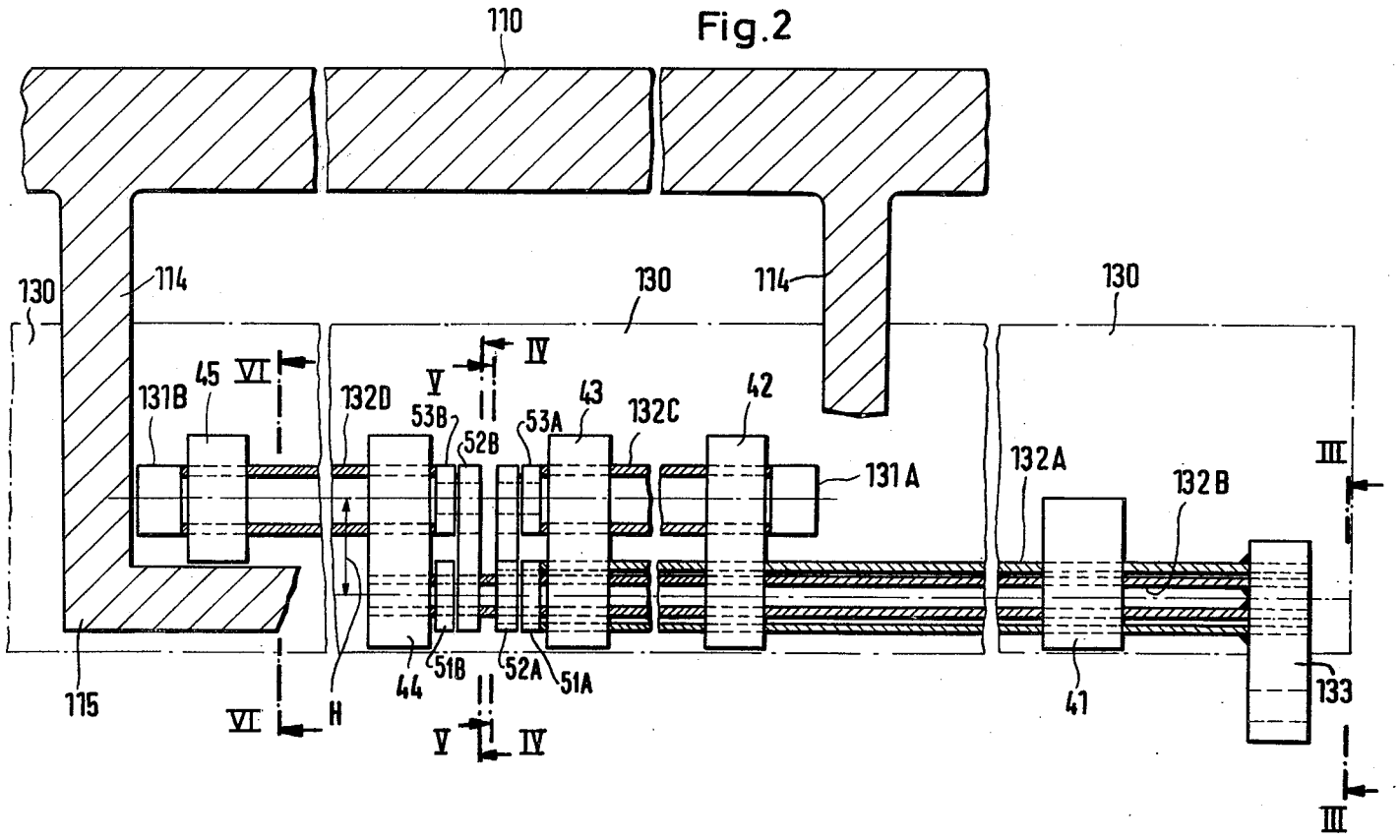
FIG. 2 is a side view, partially in section, of the clamping means of a sliding discharge gate according to the invention, in a first embodiment.
Figure 7:
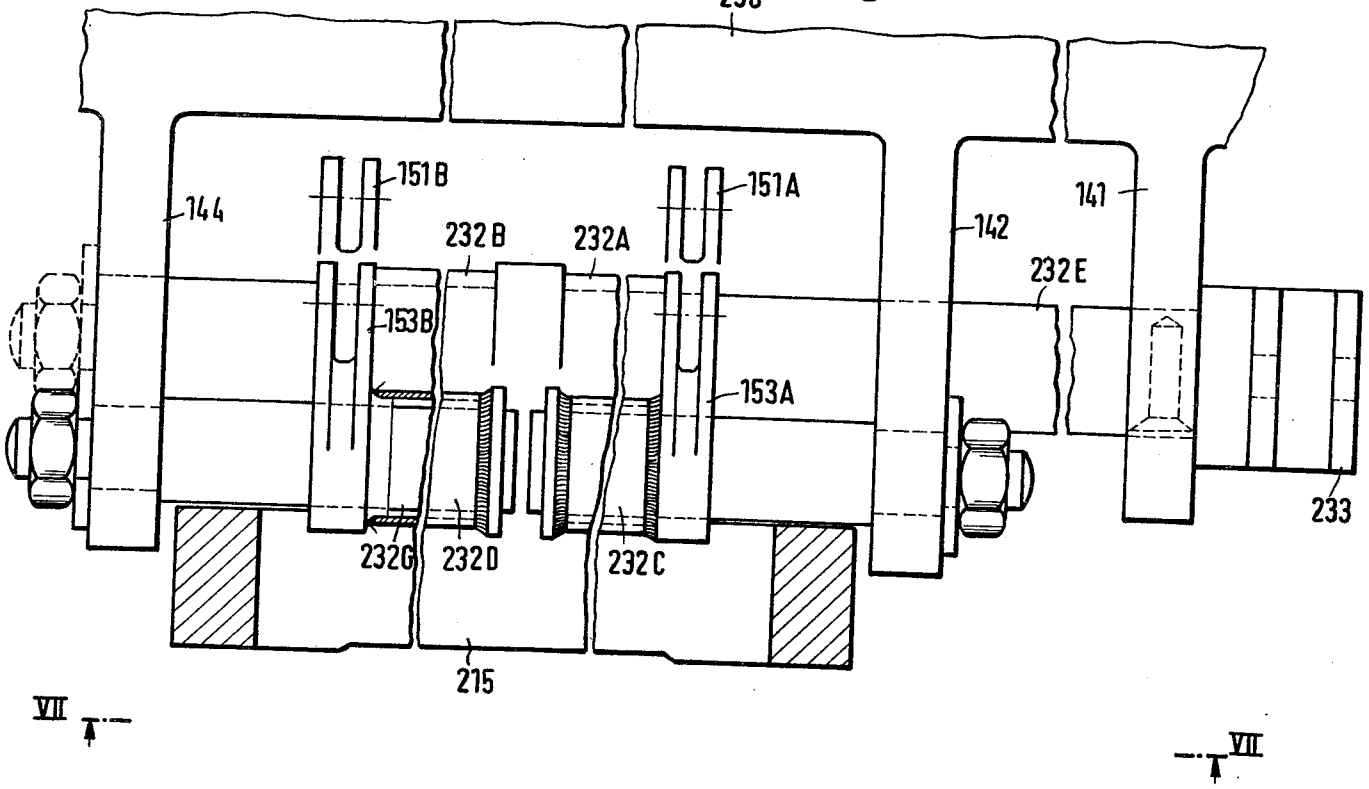
FIG. 7 is a side view, analogous to that of FIG. 2 above, however relating to a second embodiment of the invention.
Figures 8, 9:
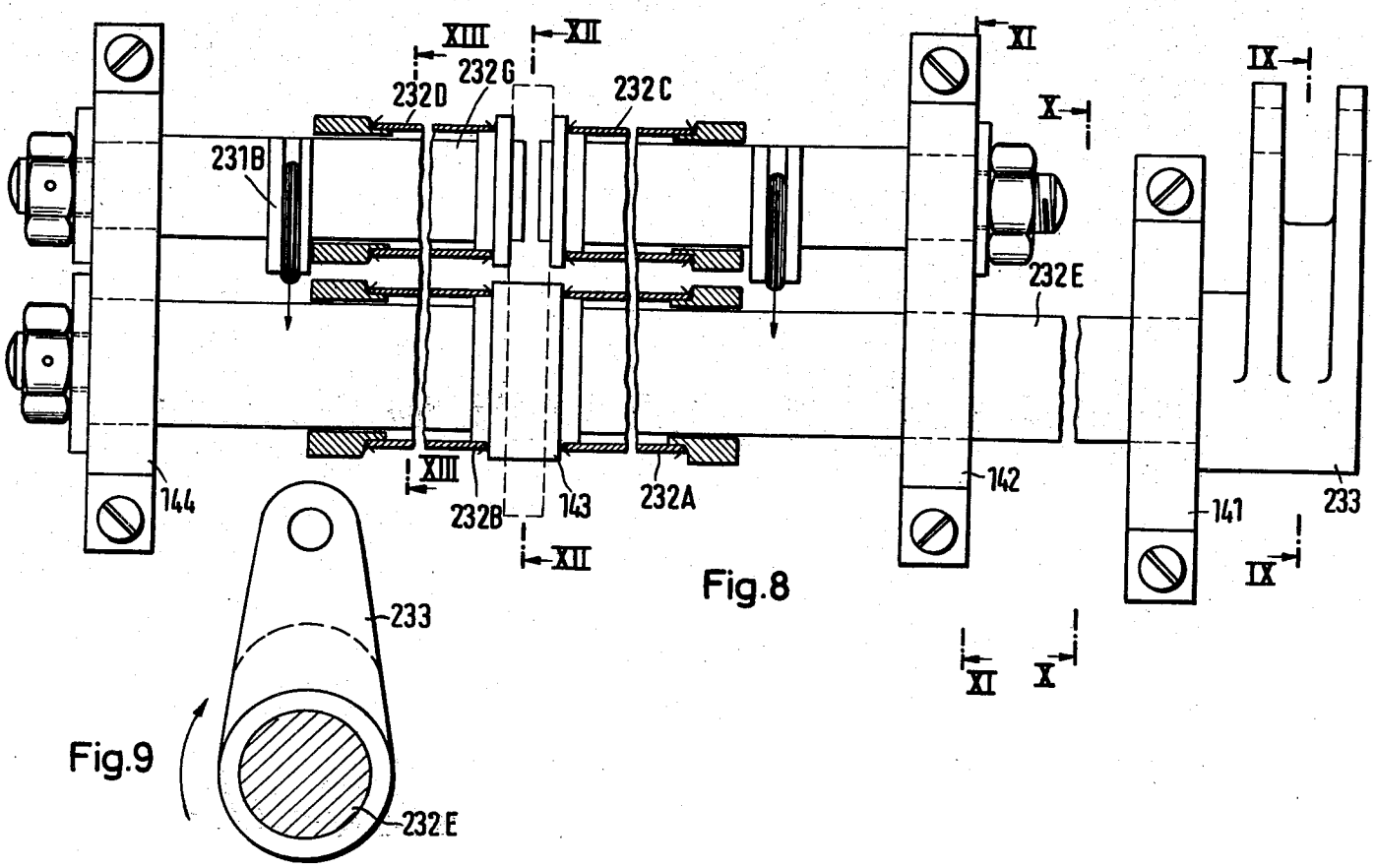
Figure 12:
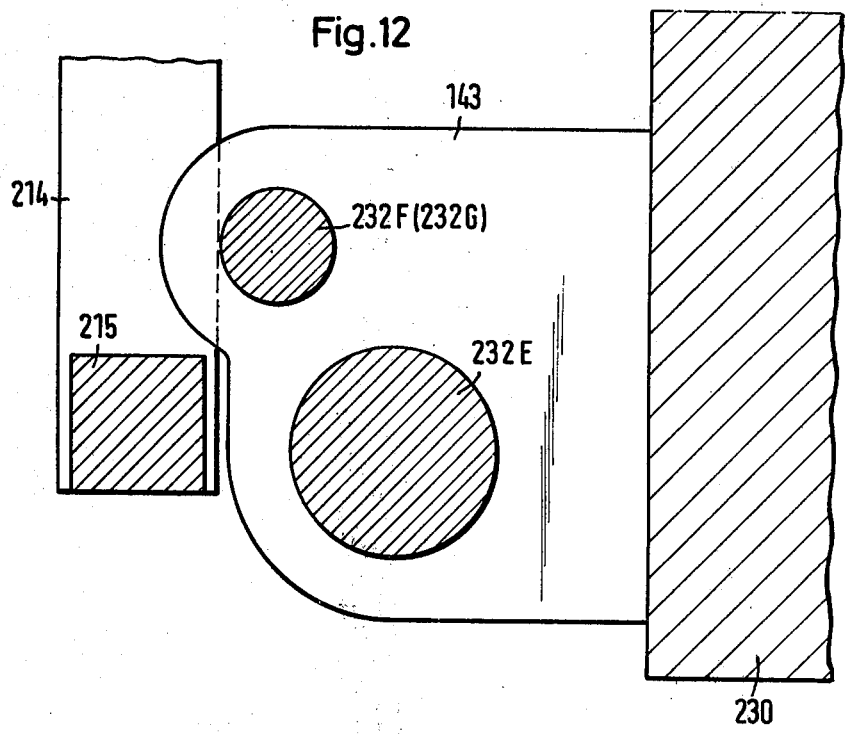
Figure 13:
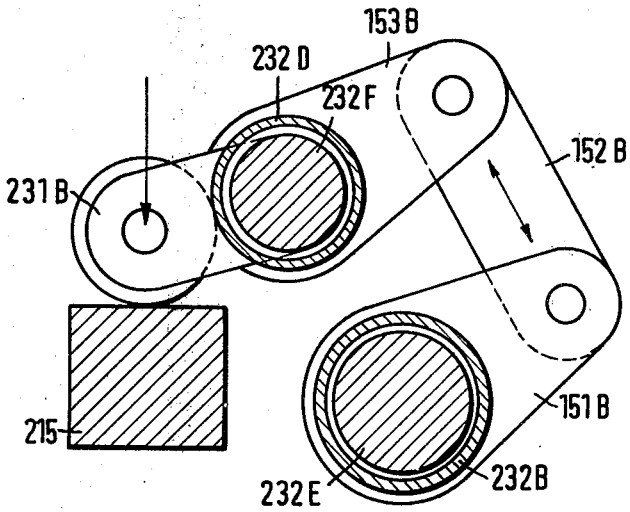

Due to the increased flexibility of the arrangement 132A and 132C on one side and 132B and 132D on the other, the rotation of the arms 131A and 131B can be different; this allows the left-hand part, as seen in FIG. 2, of the lower, fixed plate 130 to be raised a different amount to the right-hand part, as seen in FIG. 2, of the same lower, fixed plate 130. This means that when the refractory bricks 12 and 22 are separated, the application of the force F1 to the crank arms 133 causes at the first instance the front part and the rear part of the lower, fixed plate 130 to be raised equally, given that the arms 131A and 131B rotate the same amount in the absence of resistance.

As soon as the lower refractory plate touches, for instance with its rear end, the upper refractory plate, the rotation of the arm 131B is immediately arrested while the rotation of the crank arm 133 and of the front arm 131A continues; this rotation continues until the front end of the refractory plate has also touched the lower face of the upper refractory plate. Then, as the crank arm 133 continues to rotate, said rotation is completely absorbed by the torsion of the shafts 132 which press the two refractory bricks 12 and 22 in FIG. 1 one against the other with a substantially uniform force. Consequently, according to the invention, the pressures which exist to the right and to the left between the abutting faces of the two refractory bricks 12 and 22 are made substantially the same by the floating assembly of the actuating means 40.

The uniformity of pressure along each edge of the two bricks referred to above is substantially obtained due to the two pairs of flexible shafts 132. It results in such a way that a single actuating means enables one to ensure good contact over the whole surface of the two refractory bricks 12 and 22, to the right and to the left, to the front and to the rear.

The embodiment illustrated in FIGS. 7 to 13 is substantially analogous to that illustrated in FIGS. 2 to 6 with some constructional variation: the force F1 is applied in this case to the crank arm 233 which is keyed onto the shaft 232E supported by supports 141, 142, 143, 144 fixed to the lower fixed plate 230. At about halfway between two supports 214 which support the beams 215, on the external surface of the shaft 232E are welded two hollow SHAFTS 232A and 232B which extend along two sides of the support 143 indicated only with a dashed line.

At their free ends, said hollow shafts 232A and 232B are keyed to crank arms 151A and 151B, respectively, whose rotation is transmitted to the crank arms 153A and 153B, respectively, by way of small connecting rods 152A and 152B. The two hollow shafts 232C and 232D are fixed to the two crank arms 153, and at their other end, the two shafts are keyed to two solid shafts 232F and 232G, respectively, which finally are fixed to arms 231A and 231B whose ends abut against the upper face of the beam 215. The operation is clearly analogous to that illustrated by the solution shown in FIGS. 2 to 6.

What we claim is:

1. A clamping device for the height-wise elastic clamping of a moveable part of a sliding discharge gate of the type which comprises a first, upper fixed plate fixed to the base of a ladle, a second, lower fixed plate having lateral sides and being spaced from the former but by a distance suitable to receive a third, intermediate slidable plate whose position regulates the amount of opening of the discharged gate, in which are provided a clamping device which thrusts the lower fixed plate against the intermediate slidable plate and hence the latter against the upper fixed plate, characterized by said clamping device comprising in sequence:

a pair of shafts rotatably supported by the lateral side of the lower fixed plate, on the front end of each of said two shafts, a crank arm whose free end is fixed, symmetrically to the other one, to one of the two ends of a floating actuating means for moving said crank arm back and forth, on the other end of each of said two shafts, cams whose rotation, fixed to the rotation of the two shafts referred to above, causes the lower fixed plate to approach or move away from the upper fixed plate in a direction perpendicular to the planes of said plates, and wherein said two shafts are dimensioned to exhibit torsional flexibility.

2. A clamping device according to claim 1, wherein said shafts are hollow shafts hollow at least for a part of their length beginning at said front end up to the zone in which the cams are fixed to said shafts.

3. A clamping device according to claims 1 or 2, wherein each of said shafts comprises a first part at the end of which are rigidly fixed two hollow shaft parts which extend in the opposite direction, and wherein said cams are fixed to the ends of said hollow shaft parts.

4. A clamping device, according to claims 1 or 2, wherein said pair of shafts are hollow and symmetrical, a second pair of hollow shafts parallel to the first-mentioned pair of hollow shafts, rotary coupling means at the ends of said first two symmetrical hollow shafts for transmitting the rotation of the end of each of said first hollow shafts to the first end of said second pair of hollow shafts, and wherein said second pair of hollow shafts are rotationally fixed to said cams.

5. A clamping device according to claim 1, characterised by each of the crank arms symmetrically actuated by said floating actuating means, said pair of shafts is a pair of concentric hollow shafts, and each of said crank arms is rotationally fixed to a pair of said concentric hollow shafts whose other ends are respectively rotationally fixed to said cams.

6. A clamping device according to claims 1 or 2, wherein said upper fixed plate includes a pair of horizontal beams extending parallel to the longitudinal sides of said lower fixed plate, and said cams abut against said pair of horizontal beams extending parallel to the longitudinal sides of the lower fixed plates.

7. A clamping device according to claims 1 or 2, substantially embodied and constructed as described above, only by way of example, with particular reference to the enclosed sheets of drawings.

* * * * *